US005247813A

United States Patent [19]

Bottum

[11] Patent Number: 5,247,813

[45] Date of Patent: Sep. 28, 1993

[54] SUCTION ACCUMULATOR AND SIGHT GLASS STRUCTURE ASSOCIATED THEREWITH

[76] Inventor: Edward W. Bottum, 9357 Spencer Rd., Brighton, Mich. 48116

[21] Appl. No.: 840,045

[22] Filed: Feb. 24, 1992

[51] Int. Cl.[5] ..... F25B 43/00

[52] U.S. Cl. ..... 62/503; 62/125; 116/276

[58] Field of Search ..... 62/503, 125; 116/276

[56] References Cited

U.S. PATENT DOCUMENTS

| | | | |
|---|---|---|---|
| 2,600,148 | 6/1952 | Wittlin | 116/276 |
| 3,225,555 | 12/1965 | Chatlos | 116/276 |
| 3,752,185 | 8/1973 | Mullins | 116/276 |
| 3,874,323 | 4/1975 | Rottig | 62/125 |
| 4,474,034 | 10/1984 | Avery, Jr. | 62/125 |
| 4,730,465 | 3/1988 | Inoue | 62/125 |
| 4,807,474 | 2/1989 | Foster | 116/276 |
| 4,945,948 | 8/1990 | Fischer et al. | 116/276 |

*Primary Examiner*—Ronald C. Capossela
*Attorney, Agent, or Firm*—Bertram F. Claeboe

[57] ABSTRACT

This invention is directed to a sight glass structure positioned in conduit means connecting a suction accumulator and compressor in a refrigeration system. The sight glass structure herein provided may take the form of bushing means rigidly attached to the conduit means and threadably or otherwise receiving an axially passaged sight glass member providing visual communication with the interior of the conduit means, thereby permitting the detection or observation of any slugs of vaporized refrigerant passing from the suction accumulator to the compressor. Another form of the invention includes diametrally opposed bushing means affixed to the conduit means, and each bushing means is similarly equipped with sight glass members of like construction. Either form of the invention, if desired, may include within the sight glass member means impeding movement of the slugs or droplets, thereby improving the detection or observation thereof.

1 Claim, 1 Drawing Sheet

SUCTION ACCUMULATOR AND SIGHT GLASS STRUCTURE ASSOCIATED THEREWITH

BACKGROUND OF THE INVENTION

It is known in the art to which this invention pertains to provide a suction accumulator between the evaporator and compressor of a refrigeration system, in order to protect the compressor from possible damage. Vaporized refrigerant is received from the evaporator and passed on through the suction accumulator to the compressor. Any raw liquid, generally referred to in the art as "slugs" when admixed with gaseous refrigerant, is metered back to the compressor by the accumulator at a rate that will not result in damage to the compressor. The advantageous results achieved by use of a suction accumulator in a refrigeration system are more fully set forth in my U.S. Pat. No. 3,837,177, to which general reference is made.

While a high measure of success has been attained in metering raw liquid back to the compressor, primarily by provision of a small metering opening in the lower end cap on the stand pipe interiorly of the suction accumulator, a need exists in the art for means for detecting or observing the presence of slugs in the vaporized refrigerant. In this manner, should the volume of raw liquid observed be such that compressor damage is likely, the compressor could immediately be shut down and remedial action taken.

SUMMARY OF THE INVENTION

A sight glass structure is provided in the outlet from a suction accumulator connected to a compressor in a refrigeration system. The sight glass structure of this invention may take the form of a single bushing secured to conduit means connecting the suction accumulator outlet to the compressor, the bushing threadably receiving an axially passaged sight glass body. Alternatively, the sight glass structure may embody a pair of diametrally opposed bushings secured to the conduit means, each bushing threadably or otherwise receiving an axially passaged sight glass member. In either construction, if desired, means may be provided within the sight glass body or member to impede droplet movement, and thereby improve droplet detection or observation.

DESCRIPTION OF A PREFERRED EMBODIMENT

Figure 1:
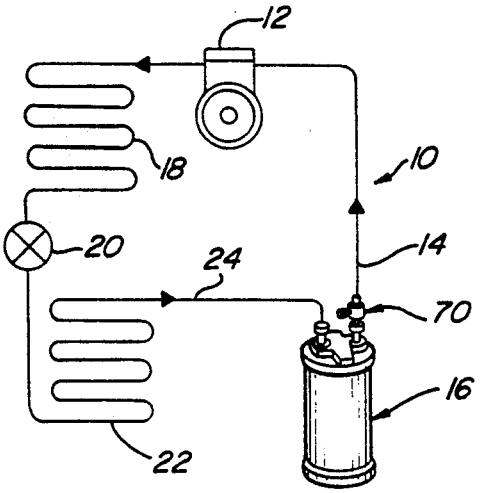
FIG. 1 is a schematic diagram of a refrigeration system showing the present invention in association with a suction accumulator forming a part of the system.

Referring now first to FIG. 1 of the drawings, a conventional refrigeration system 10 is shown, the system being charged with a refrigerant material. As is normal, compressor 12 receives gaseous refrigerant through suction conduit means 14 from suction accumulator 16, the gaseous refrigerant is compressed, and passes to condenser 18. The refrigerant is condensed to a liquid state at 18, and passes through expansion valve 20 whereat its temperature and pressure are reduced. The cooled refrigerant then passes to evaporator 22, wherein it is vaporized by absorbing heat, and then enters suction accumulator 16 through conduit means 24.

Figure 2:
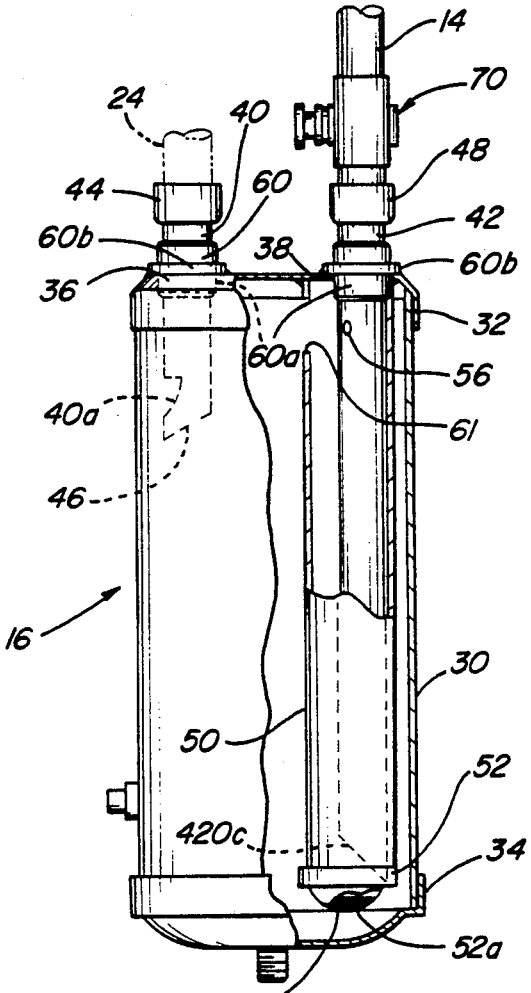
FIG. 2 is a side elevational view of an exemplary form of suction accumulator incorporating an illustrative sight glass structure.

Suction accumulator 16, with which the sight glass structure of the present invention is associated, may take various forms. An exemplary form of suction accumulator 16 is shown in FIG. 2, and the specific structural features thereof and preferred method of assembly are more fully disclosed in my U.S. Pat. No. 5,075,967 issued Dec. 30, 1991.

As is set forth in the noted patent, the suction accumulator 16 comprises a generally cylindrical shell or casing 30 to which at opposite ends are brazed cap or closure means 32 and 34. Cap means 32 is apertured at 36 and 38 to receive inlet tube 40 and outlet tube 42, respectively. A metal tag (not shown) is preferably secured to the cap means 32 adjacent the inlet tube 40 to prevent reverse connection of the suction accumulator 16, thereby avoiding damage to the compressor 12.

Support for the inlet tube 40 and outlet tube 4 within the openings 36 and 38, respectively, are bushing means 60. The bushing means 60 is formed to include a tubular main body portion **60*a* and integral larger diameter central ring portion 60*b*. During installation, the lower or inner end of each of the bushing means 60** is flared against the inner surface of the top cap or closure means to fixedly secure the same thereto.

Copper inlet tube 40 may mount at one end copper nipple means 44, or in the alternative may be expanded, and at its opposite end adjacent the bottom thereof has an opening notch **40*a* forming baffle 46 for deflecting gaseous phase change material from inlet tube 40** into shell or casing adjacent the top thereof.

Copper outlet tube 42 may mount at one end copper expanded quill means 48. Opposite end of outlet tube 42 is beveled as at **42*a*. Outlet or inner suction tube 42 is received within stand pipe or outer suction tube 50, and inner tube 42 is of lesser diameter than outer tube 50, providing thereby considerable space within the outer tube or stand pipe 50**, which permits flow of gaseous material therethrough.

As is shown in FIG. 2, stand pipe or outer suction tube 50 is provided on the lower end with cap means 52, centrally apertured at **52*a* to provide a small metering orifice. If desired, a small mesh screen 526 may be spot welded over the opening 52*a* to prevent the plugging thereof Stand pipe or outer suction tube 50 at the opposite or upper end thereof may be provided with holes or openings 61, which are effective to direct the passage of refrigerant gas between the inlet tube 40 and upper end of the stand pipe 50. With respect to the outlet or inner suction tube 42 at the upper end thereof, a new opening 56 may be provided to equalize the pressure within the tubes 42 and 50** during the "off cycle".

It is known in the prior art to employ sight glass structures in association with other components of a refrigeration system. Receivers are illustrative of such components, and an exemplary form of sight glass structure and expeditious manner of installing the same in a refrigeration vessel is disclosed in my U.S. Pat. Nos. 5,000,367 and 5,076,198.

As is noted in the patents to which reference was just made, the sight glass structure shown therein provides visual access to the interior of a refrigeration vessel, exemplified by a receiver. However, as was pointed out hereinabove, it is highly desirable in a refrigeration system to detect the presence of slugs in the vaporized refrigerant prior to passage into the compressor from the suction accumulator.

Such detection or observation means, by the present invention, preferably takes the form of sight glass structure generally indicated by the numeral 70 in FIGS. 1–4. As shown in FIGS. 1 and 2, sight glass structure or assembly 70 is suitably connected to conduit means 14 communicating suction accumulator 16 with compressor 12. For this purpose, sight glass structure 70 may be either cross-shaped or T-shaped when viewed in side elevation, and comprises a tubular central or main body portion 72 brazed or otherwise secured at opposite ends to conduit means 14. One or both ends of main body portion 72 may be flared to facilitate the connection to conduit means 14.

Fixedly attached to tubular body portion 72 by brazing or other suitable techniques is bushing means 74 formed to include an internally threaded main portion **74*a* and reduced diameter neck portion 74*b* received in hole or opening 72*a* in tubular body portion 72. Threadably received in main portion 74*a* of bushing means 74 is an axially passaged sight glass body 76 formed to provide an externally threaded shank portion 76*a* integral with an enlarged head portion 76*b* formed with a recess or pocket 76*c* therein fixedly receiving sight glass 78. The glass 78** is of course transparent, and is fabricated in disc form of an heat and pressure resistant glass composition.

Figure 3:
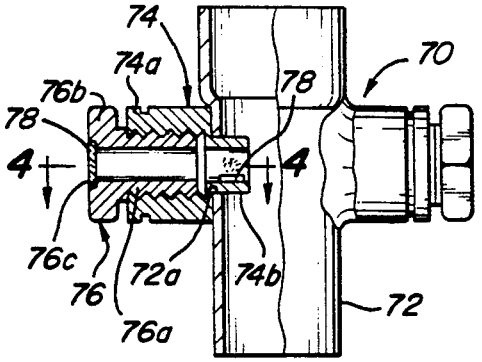
FIG. 3 is a side elevational view of another form of sight glass structure.
Figure 4:
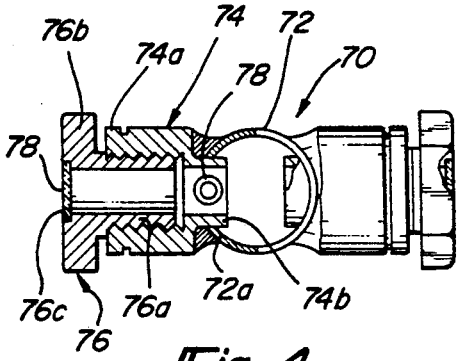
FIG. 4 is a partial sectional view taken substantially along the line 4—4 of FIG. 3.

It is believed now apparent from the preceding description when related to the accompanying views of the drawings that the presence of droplets or slugs in the vaporized refrigerant may be readily observed by viewing through sight glass 78 of sight glass structure 70. Generally speaking, only a single bushing means 74 and sight glass body 76 combination of T-shaped configuration is required for effective observation of conditions within the tubular central body portion 72 of the sight glass structure. However, when the sight glass structure 70 is cross-shaped in configuration as shown in FIGS. 3 and 4, it would be expeditious to shine a flashlight through one end of the structure 70, and observe the presence of possible slugs through the opposite end thereof.

To further aid in viewing conditions within the tubular body portion 72 of the sight glass structure 70, a small cup or other device 78 may be provided within reduced diameter neck portion **74*b* of bushing means 74. It is anticipated that a small quantity of refrigerant may condense in the cup 78, and may be observed to the fluttering therein. In this case, appropriate remedial action would be taken in the refrigeration system 10 shown in FIG. 1** of the drawings.

Figure 5:
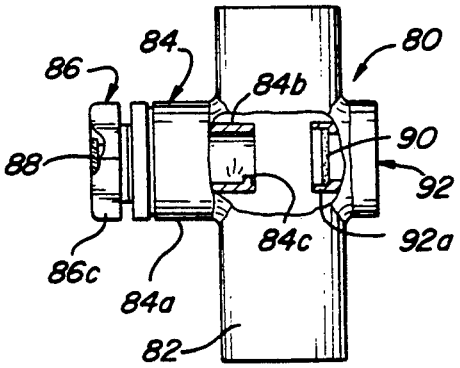
FIG. 5 is a side elevational view of a further form of sight glass structure.

Referring now to FIG. 5, there is shown a modified form of sight glass structure designated in its entirety by the numeral 80. The structure 80 comprises a tubular body portion 82 connected to conduit means 14 communicating the suction accumulator 16 with compressor 12. Bushing means 84 shaped to include a body portion **84*a* and neck portion 84*b* threadably receives axially passaged sight glass body 86 having head portion 86*a* recessed to fixedly receive transparent sight glass 88**.

Neck portion **84*b* of bushing means 84 is formed interiorly with a relatively low dam or like device 84*c* for the purpose of trapping any droplets of condensed refrigerant. The observation of any such droplets may be improved by provision of mirror means 90 supported by reduced diameter tubular neck portion 92*a* of relatively short length bushing means 92**.

Various changes and modifications to the present invention have been noted herein, and these and other variations may be practiced without departing from the spirit of the invention or the scope of the subjoined claims.

I claim:

1. In a refrigeration system comprised of a suction accumulator and compressor connected by conduit means, a sight glass structure comprising bushing means secured to said conduit means a distance from said compressor adjacent to said suction accumulator, said bushing means being formed to include an integral tubular portion extending into said conduit means, annular means formed upon the inner diameter of said tubular portion for impeding the passage of any slugs which might be passing through said conduit means, and an axially passaged sight glass member received in said bushing means and in visual communication with the interior of said conduit means for detecting any slugs impeded by said annular means during passage therethrough.

* * * * *